US012370588B2

(12) United States Patent
Benedetti et al.

(10) Patent No.: US 12,370,588 B2
(45) Date of Patent: Jul. 29, 2025

(54) METHOD FOR REVAMPING A PLANT FOR PRODUCING FLAT ROLLED PRODUCTS

(71) Applicant: Danieli & C. Officine Meccaniche S.p.A., Buttrio (IT)

(72) Inventors: Gianpietro Benedetti, Tricesimo (IT); Paolo Bobig, San Canzian d'Isonzo (IT); Matteo Remy Bulfone, Colloredo di Monte Albano (IT)

(73) Assignee: DANIELI & C. OFFICINE MECCANICHE S.P.A., Buttrio (IT)

( * ) Notice: Subject to any disclaimer, the term of this patent is extended or adjusted under 35 U.S.C. 154(b) by 372 days.

(21) Appl. No.: 18/100,672

(22) Filed: Jan. 24, 2023

(65) Prior Publication Data

US 2024/0157417 A1 May 16, 2024

(30) Foreign Application Priority Data

Nov. 11, 2022 (IT) ..... 102022000023301

(51) Int. Cl.
*B21B 1/32* (2006.01)
*B21B 37/16* (2006.01)
*B21B 45/00* (2006.01)

(52) U.S. Cl.
CPC ..... *B21B 1/32* (2013.01); *B21B 37/16* (2013.01); *B21B 45/004* (2013.01)

(58) Field of Classification Search
CPC ..... B21B 1/32; B21B 37/16; B21B 45/004; B21B 1/24; B21B 1/34; B21B 37/74; B21B 2201/02; B21B 2261/04; B21B 2261/20; B21B 1/22; B21B 2001/225; B21B 1/30; B21B 45/06
See application file for complete search history.

(56) References Cited

U.S. PATENT DOCUMENTS 8,042,602 B2 * 10/2011 Wechsler ..... B22D 11/20 164/428

* cited by examiner

*Primary Examiner* — Lee A Holly
(74) *Attorney, Agent, or Firm* — Panitch Schwarze Belisario & Nadel LLP

(57) ABSTRACT

A method for revamping a starting rolling plant, for producing a final strip starting from a slab having a determinate starting thickness, including: at least one heating furnace configured to heat at least the slab to a determinate starting temperature; at least one reversible roughing stand configured to subject the slab to one or more rolling passes in order to obtain an intermediate rolled product; and a rolling train disposed operatively in line with the roughing stand, including at least one pre-finishing stand and a plurality of finishing stands and configured to reduce the thickness of the intermediate rolled product, until the final strip having a determinate final thickness is obtained.

7 Claims, 6 Drawing Sheets

METHOD FOR REVAMPING A PLANT FOR PRODUCING FLAT ROLLED PRODUCTS

CROSS-REFERENCE TO RELATED APPLICATIONS

This application claims priority under 35 U.S.C. § 119(b) to Italian Application No. 102022000023301, filed Nov. 11, 2022, the disclosures of each of which are incorporated herein by reference.

FIELD OF THE INVENTION

The present invention concerns a method for revamping a rolling plant for producing flat rolled products such as, for example, but not limited to, steel strip wound in reels or coils.

BACKGROUND OF THE INVENTION

Rolling plants known as Hot Strip Mills, or more simply indicated hereafter by the acronym "HSM", are known, designed for the hot production of metal strip starting from slabs typically from about 150 mm to about 350 mm thick.

Two examples of such plants are shown schematically in FIGS. 1 and 2.

These plants comprise heating furnaces 16 of the "Walking Beam" type in which the slabs are heated and, in line, one or two reversible roughing stands 23. In the case where they comprise a single roughing stand 23 (FIG. 1) the stand generally performs from five to seven rolling passes while, in the case where they comprise two roughing stands 23 (FIG. 2), the first generally performs three rolling passes while the second performs from three to five further rolling passes, in order to obtain an intermediate bar having a thickness comprised between about 35 mm and about 45 mm.

Normally, downstream of the reversible stands 23 there is provided a transfer table, for example provided with passive insulated hoods 99, that is, without heating burners, to limit the heat losses of the bar.

Downstream of the transfer table there is a shear 27, normally of the Drum Shear type, sized to cut a rolled product which normally has a thickness comprised between about 35 mm and about 45 mm.

Immediately downstream of the shear 27 there is provided a water descaler 24 and a continuous rolling train, or compact finishing train 25, having six or seven finishing stands disposed in line and in close succession to each other, an outlet table 34, also called "run-out table", provided with cooling showers 33 and two or more winding reels 36, 38 (downcoilers) which wind the finished strip to form the reels or coils.

In order for the rolling in the compact finishing train 25 to take place in the austenitic range, that is, without phase transformations in the structure of the steel, the strip has to leave the last stand of the finishing train 25 at a temperature not lower than 830° C.

Therefore, the rolling mass flow in the compact finishing train 25 has to be set to obtain said optimum temperature of at least 830° C. at the outlet of the last finishing stand.

It is also known that the rolling mass flow is calculated as the product of the thickness of the strip and its rolling speed. Therefore, when a certain rolling mass flow is set, the rolling speed of the strip is determined only by the final thickness of the latter.

A first disadvantage of known plants is that the heating of the thick, or conventional slabs, takes place in heating furnaces which use gas burners to raise the temperature of the product up to about 1200-1250° C. This temperature is necessary because all the temperature losses along the line must be taken into account so that the strip leaves the last rolling stand at a temperature, as we said, of at least 830° C.

However, the slab heating operation requires long times, for example comprised between 4 and 7 hours, requiring a very high gas consumption by the burners, with consequences on environmental emissions and production costs.

Furthermore, in the case of heating particular steels, the thermal targets can be even higher, with a consequent increase in both gas consumption and emissions. It should also be added that, in order to differentiate the heating according to the type of steel and the required final quality, it is necessary to wait for the correct heating of the furnace to the desired temperature, higher or lower, and this limits production flexibility, given that it will be necessary to organize production to heat products that are thermally similar to each other, so as to try to optimize the times needed to reach the target temperature of the furnace. Due to this, the delivery times of the finished product are lengthened, which is increasingly required in small batches.

Another disadvantage of conventional HSM plants is that it is necessary to limit the maximum speed of the strip exiting from the finishing train in order to prevent the head of the strip, in the path that goes from the last stand to the winding reel 36, 38, from rising dangerously because of aerodynamic-type effects due to speed. Typically, the maximum speed allowed for the head of the strip on the run-out table is about 11-12 m/s; this speed can then be increased after the winding on the winding reel has started.

By head of the strip we conventionally mean the front end of the strip which, in the direction of travel, meets the first stand of the finishing rolling line.

Similarly, by tail of the strip we mean the rear end of the strip which, in the direction of travel, enters the first stand of the finishing rolling line last.

The portion of strip comprised between the head and tail is referred to as the body of the strip.

Because of this speed limitation it may happen that, especially for thin strip, for example with thicknesses of 1.2 mm or less, it is not possible to reach said optimum temperature of at least 830° C. at the outlet of the last finishing stand.

To prevent this from happening, in known plants, after the head enters the winding reels 36, 38 the so-called "speed-up" of the stands of the compact finishing train 25 is carried out, in order to make the strip transit faster and thus reduce losses in temperature, allowing the body and tail of the strip to exit from the compact finishing train 25 at the optimum temperature not lower than 830° C.

This type of solution, if applied for example to the production of a rolled product having a final thickness of 1.2 mm, and as shown schematically in the graph in FIG. 3, requires an acceleration of the tail of about 40%, in order to guarantee a minimum temperature of 830° C. at exit from the last stand, since the only active heat input coincides solely with the heating furnace upstream of the line.

However, if one wants to obtain rolled products with rolling thicknesses of less than 1.2 mm, despite using a speed-up of even 60%, with which the typically limit speed of 19-20 m/s is reached, with conventional HSM plants it is not possible to guarantee that the desired minimum temperature of 830° C., required at exit from the last stand, is maintained, since the temperature loss of the product being rolled is excessive, with consequent and undesirable phase changes of the steel, which affect the quality of the final product.

As shown schematically in the graph in FIG. 4, with a traditional HSM plant, in order to produce a 1.0 mm thick strip, and a limit speed-up as indicated above, the exit temperature from the last rolling stand is around 780° C., not only for the head but also for the tail of the strip, making a quality production for strip of such a limited thickness substantially impossible.

To overcome these limitations, solutions have been proposed which provide to carry out induction heating immediately in front of the compact finishing train in order to enter with the bar at a higher temperature, but since the heating is carried out before the initial stands, which are the slowest, a greater amount of scale is formed due to the higher temperature for the same time of exposure to the air of the bar being rolled in the initial stands.

Furthermore, the compact finishing train 25, in conventional HSM plants, does not allow to carry out a further high-pressure descaling step inside the train itself, before the winding of the strip.

This means that the scale that forms following the exposure to high temperature air of the bar being rolled in the initial passes, since it cannot be removed, is imprinted into the strip during the rolling in the final passes, with a consequent reduction in the quality of the finished product.

Currently, the need to also produce quality strip with a thin thickness from 1.8 mm and lower, to a minimum value comprised between 0.9 and 1.2 mm, is increasingly felt in HSM plants, overcoming the disadvantages of the state of the art. Quality must be understood both in terms of surface quality of the strip and also in terms of the final mechanical characteristics required by the market.

One purpose of the invention is therefore to perfect a method for revamping a Hot Strip Mill plant so that it can also produce thin thicknesses of quality strip, without negatively affecting the productivity of the existing plant, which can reach up to 6 or more million tons/year.

Another purpose of the present invention is to carry out said revamping with a reduced economic and operational impact compared to the existing plant.

Another purpose of the present invention is to provide an existing Hot Strip Mill plant, in order to keep the mechanical and geometric properties uniform along the entire length of the coil produced.

The Applicant has devised, tested and embodied the present invention to overcome the shortcomings of the state of the art and to obtain these and other purposes and advantages.

SUMMARY OF THE INVENTION

The present invention is set forth and characterized in the independent claims. The dependent claims describe evolved and perfected aspects of the independent claim.

In accordance with the above purposes, a method according to the present invention is applied for revamping an existing hot strip mill plant for the production of a steel strip starting from a slab having a determinate starting thickness, in which the revamped plant comprises:

- at least one heating furnace configured to heat at least the slab to a determinate starting temperature, for example comprised between about 1100-1150° C. and 1200° C.;
- at least one roughing stand, of the reversible type, which is configured to subject the slab to one or more rolling passes in order to obtain an intermediate rolled product, for example with a thickness comprised between about 45 mm and about 80 mm; and
- a rolling train disposed operatively in line with the roughing stand, comprising at least one group of pre-finishing stands and one group of finishing stands, and configured to reduce the thickness of the intermediate rolled product, until a final strip is obtained having a minimum final thickness smaller even than 1.2 mm.

Therefore, the existing plant to be revamped is generally configured as a traditional hot strip mill rolling plant which operates in coil-to-coil mode, that is, of the discontinuous type, in which the rolled product is obtained starting from single slabs, for example with a thickness comprised between about 150 mm and about 350 mm, with all the operational, dimensional and production characteristics that this type of plant entails.

In the existing plant, there are generally disposed in sequence, from upstream to downstream, three heating furnaces, a first water descaling device, a vertical or edging stand for working the edges, which is combined with at least one reversible roughing stand, configured to subject the slab to a determinate number of rolling passes and reduce its thickness until an intermediate rolled product (or bar) is obtained, which normally has a thickness comprised between about 35 mm and about 45 mm. A transfer table follows, for example provided with passive insulated hoods, that is, without heating burners, to limit the heat losses of the bar.

In some hot strip mill plants, at the end of the transfer table there is a coil-box in which the intermediate rolled product is wound into a reel to be subsequently unwound.

Downstream of the transfer table, or of the coil-box, there is a shear, normally of the Drum Shear type, sized in order to cut the intermediate rolled product.

Immediately downstream of the shear there is provided a second water descaling device and a continuous rolling train, or compact finishing train, having six or seven finishing stands disposed in line and in close succession to each other, an outlet table, also called "run-out table", provided with cooling showers, and two or more winding reels (downcoilers) which wind up the finished strip to form the reels or coils.

In accordance with one aspect of the present invention, in order to obtain the desired revamped plant, the method provides at least one step of modifying the existing compact finishing train, in which at least the first stand is moved away from the remaining stands located downstream of it and brought closer to the reversible roughing stand, at a minimum distance "D" from it, whereby the intermediate rolled product is not operatively engaged with both stands simultaneously.

With this displacement, a first group of stands is configured, called pre-finishing unit, positioned at a predetermined distance "d" from the second group of stands, called finishing unit.

According to the present invention, the modification step provides that the pre-finishing unit comprises from one to two pre-finishing stands and that the finishing unit comprises from five to six finishing stands.

Depending on the initial configuration of the existing plant and the final division of the finishing rolling train to be obtained, it may be necessary to insert a new stand in the pre-finishing unit, in addition to those obtained from the existing train.

For example, if the existing train has seven stands, the first two are moved to the pre-finishing unit, giving rise to a 2+5 configuration.

If, on the other hand, the existing train has six stands, the first stand is moved to the pre-finishing unit and, in order to obtain the 2+5 configuration, a new stand is added to the pre-finishing unit.

In the space comprised between the reversible stand and the pre-finishing unit, the existing passive insulated hoods are kept for the amount necessary to cover part of said distance "D".

If the existing plant was provided with a coil-box, according to the invention it is preferable to remove it in the revamped plant, replacing it with passive insulated hoods.

Advantageously, there is provided at least one step of installing a new rapid heating device, for example an inductor consisting of selectively activatable modules, which is interposed between the pre-finishing unit and the finishing unit, so as to heat the pre-finished rolled product.

According to another aspect of the present invention, the method provides to remove the existing drum shear and to position it, after possible revamping, between the pre-finishing unit and the rapid heating device.

According to another aspect of the present invention, the method provides to position the second existing descaling means in front of the pre-finishing unit.

Advantageously, the method provides to insert new third water descaling means between the rapid heating device and the first stand of the finishing unit, with the function of further cleaning the surface of the pre-finished rolled product of the scale before it enters the finishing unit. In this way, the scale that has formed on the surface of the pre-finished product is removed, thus avoiding quality defects on the rolled strip, such as imprinted scale, for example.

The at least one reversible roughing stand is in turn equipped with descaling means mounted on board and being an integral part of the stand itself, which are disposed both on the inlet side and also on the outlet side of the stand.

The revamped plant according to the method described above operates as indicated below.

The outlet temperature of the slab at exit from the heating furnaces is comprised between about 1100-1150° C. and about 1200° C., therefore about 50-150° C. lower than the original temperature, with consequent benefits in terms of gas consumption, and corresponding costs, atmosphere emissions and scale formation, thanks to the shorter permanence time in the furnace.

If the existing plant is equipped with only one reversible roughing stand, which remains unchanged in the revamped plant, the number of rolling passes is reduced from 7 to 5.

If the existing plant is equipped with two reversible roughing stands, which remain unchanged in the revamped plant, the number of rolling passes is equal to 3 in the first stand while it is reduced from 3-5 to 1-3 in the second stand.

In both cases, the intermediate rolled product obtained at exit from the roughing stand/s has a thickness comprised between about 45 mm and about 80 mm. By way of example only, at the end of the required roughing passes, the intermediate rolled product has a temperature which ranges from about 1020° C. to about 1120° C.

The pre-finishing unit is able to reduce the thickness of the intermediate rolled product, in order to obtain a pre-finished rolled product, for example with a thickness comprised between about 10 mm and about 50 mm.

In the revamped version of the plant, the shear head and tail trims the pre-finished product on a lower thickness therefore, with the same trimmed portion, the weight of rejected material is lower, thus positively affecting the yield of the plant.

In the rapid heating device, the heating can occur, advantageously, up to an outlet temperature therefrom comprised between about 1000° C. and about 1100° C., or in any case to a temperature such that, also as a function of the operating and product parameters, the temperature of the final strip, at exit from the last finishing stand, is higher than at least 830° C.

This advantageous aspect of the solution according to the present invention allows the steel to remain substantially in the austenitic range during rolling in the finishing unit and, therefore, without phase transformations before exiting the last finishing stand.

In this way, it is possible to provide the production of rolled products that are substantially uniform both as regards mechanical properties and also as regards geometric properties, along the entire length of the coil produced.

Furthermore, the installation of the induction heating device between the pre-finishing and finishing stands allows to relieve the upstream gas heating furnace of a portion of the thermal contribution to be given to the slab, thus reducing gas consumption and emissions compared to the same plant before the revamping according to the present invention.

The finishing stands, on the other hand, are configured to reduce the thickness of the pre-finished rolled product, so as to obtain the final strip, for example with a thickness comprised between about 1 mm and about 26 mm.

By making the modifications according to the steps of the method of the present invention to an existing conventional hot strip mill plant, this plant is revamped allowing to produce flat rolled products with a thin thickness from 1.8 mm and lower, to a minimum value comprised between 0.9 and 1.2 mm, overcoming the quality, productivity and yield problems that the conventional plant presents in producing such thin thicknesses.

Therefore, by substantially dividing the existing rolling train into two macro pre-finishing and finishing rolling units, and interposing a rapid heating device between them, the starting HSM plant is revamped to produce quality thin thicknesses, without negatively affecting the productivity of the plant itself, which can reach up to 3-5 million tons/year.

DESCRIPTION OF THE DRAWINGS

These and other aspects, characteristics and advantages of the present invention will become apparent from the following description of some embodiments, given as a non-restrictive example with reference to the attached drawings wherein.

Figure 1:
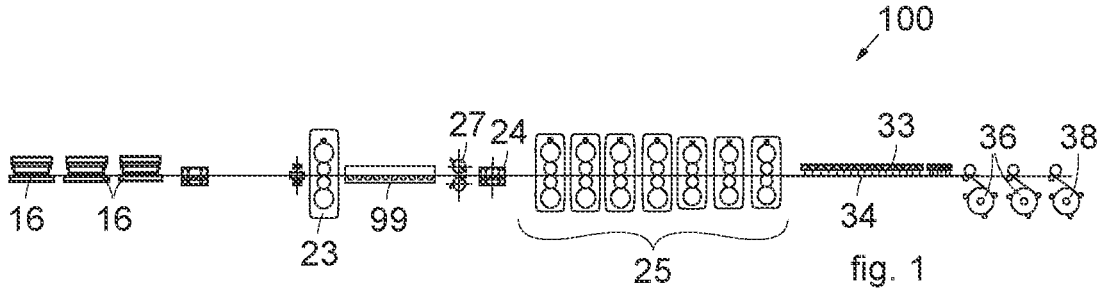
fig. 1 (PRIOR ART)
FIGS. 1 and 2 are schematic representations of two types of HSM plants for producing flat rolled products, in accordance with the prior art.

We must clarify that in the present description the phraseology and terminology used, as well as the figures in the attached drawings also as described, have the sole function of better illustrating and explaining the present invention, their function being to provide a non-limiting example of the invention itself, since the scope of protection is defined by the claims.

To facilitate comprehension, the same reference numbers have been used, where possible, to identify identical common elements in the drawings. It is understood that elements and characteristics of one embodiment can be conveniently combined or incorporated into other embodiments without further clarifications.

DESCRIPTION OF SOME EMBODIMENTS OF THE PRESENT INVENTION

Figure 5:
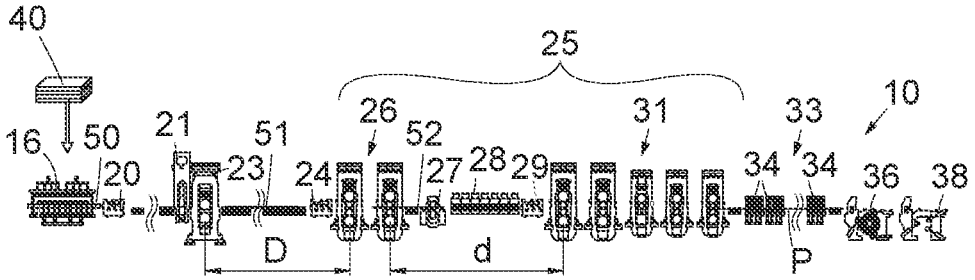
FIGS. 5 and 6 are schematic representations of the corresponding HSM plants shown in FIGS. 1 and 2, after having been subjected to the method for revamping a plant for producing flat rolled products, in accordance with the present invention.
Figure 6:
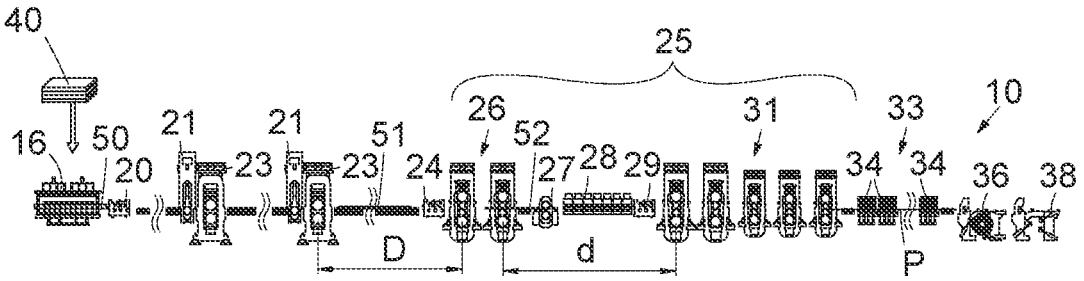

With reference to FIGS. 5 and 6, these show two types of HSM plants 10, each obtained from the revamping of corresponding starting operating HSM plants 100, according to the method of the present invention.

The plants 10 are revamped with respect to the starting plants 100, for rolling a flat rolled product, for example a final strip P, with a thickness comprised between about 0.9 mm and about 26 mm wound to form a reel, or coil, starting from slabs 50 having a starting thickness comprised between about 150 mm and about 350 mm.

Both the starting plant 100 as well as the revamped plant 10 comprise one or more gas heating furnaces 16, for example of the type known in the sector with the term "walking beam", configured to receive and heat to a determinate starting temperature at least one slab 50, supplied even at ambient temperature.

In the solutions with the revamped plant 10, at exit from the gas furnace 16 the slab 50 has a temperature comprised between about 1100-1150° C. and about 1200° C., instead of the original 1200° C.-1250° C. The outlet temperature of the slab at exit from the heating furnaces is therefore 50-150° C. lower than the original one, with consequent benefits in terms of gas consumption, and corresponding costs, atmosphere emissions and scale formation, thanks to the shorter residence time in the furnace.

A warehouse 40 can also be part of the plant 10, which cooperates with the gas heating furnace 16 and is configured to store the slabs 50, for example coming from another production site or from another production area of the same factory. The warehouse 40 allows to selectively feed at least one slab 50 to the gas heating furnace 16, according to desired feeding sequences and timings.

Figure 3:
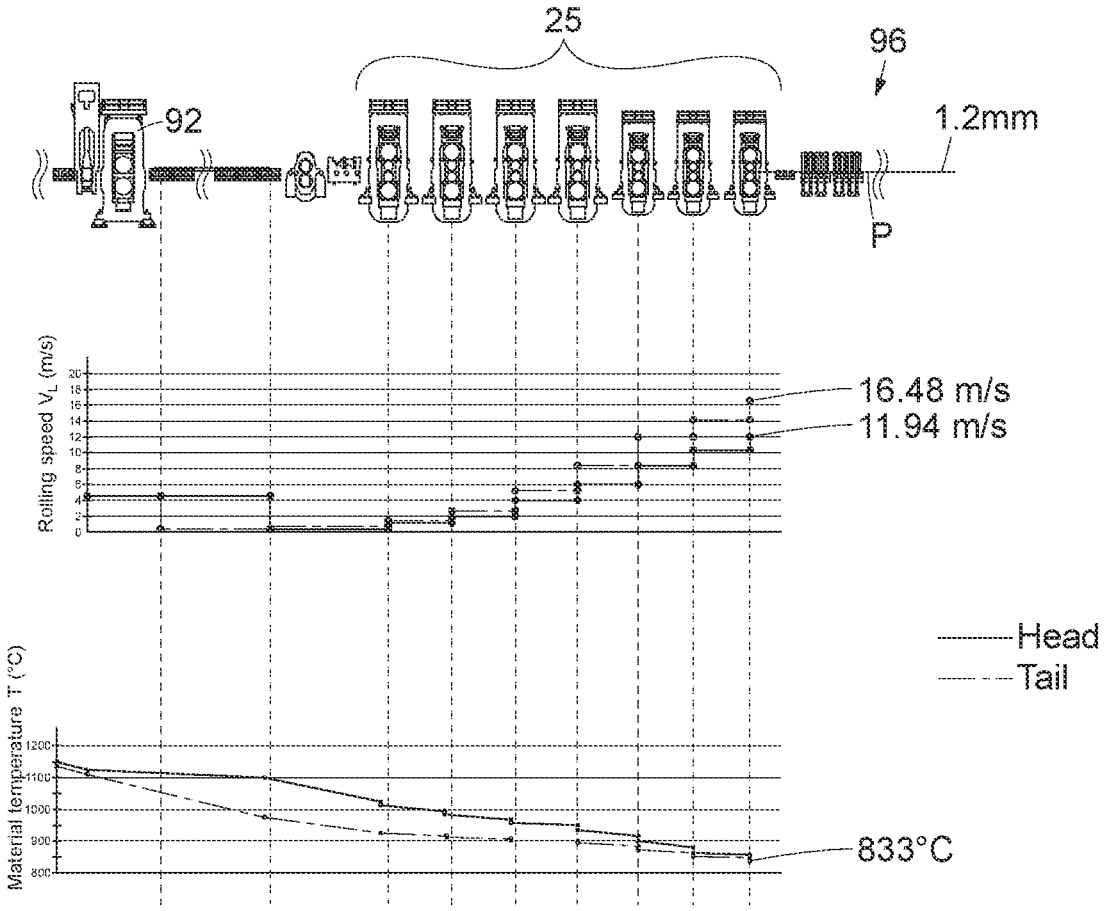
fig. 3 (PRIOR ART)
FIGS. 3 and 4 are graphic representations of the relation between rolling speed and outlet temperature of rolled products of different thicknesses, in accordance with the prior art.

In the original type of plant 100 shown in FIG. 1, and in the corresponding revamped plant 10 of FIG. 3, downstream of the gas heating furnace 16 there are disposed, in sequence, a first water descaling device 20, a vertical or edging stand 21 and a reversible roughing stand 23 which is configured to subject the slab 50 to a determinate number of passes and reduce its thickness until an intermediate rolled product 51 is obtained.

Figure 2:
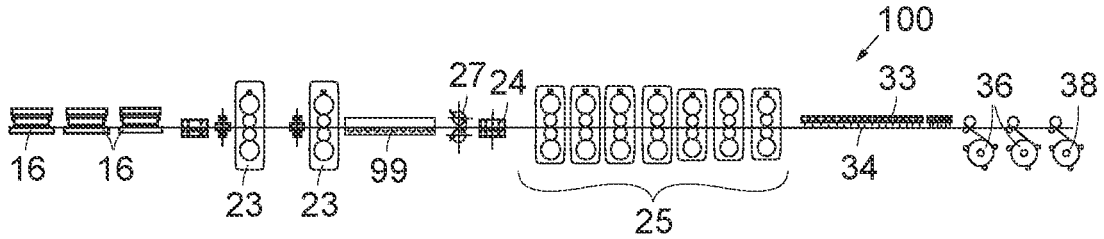
fig. 2 (PRIOR ART)
Figure 4:
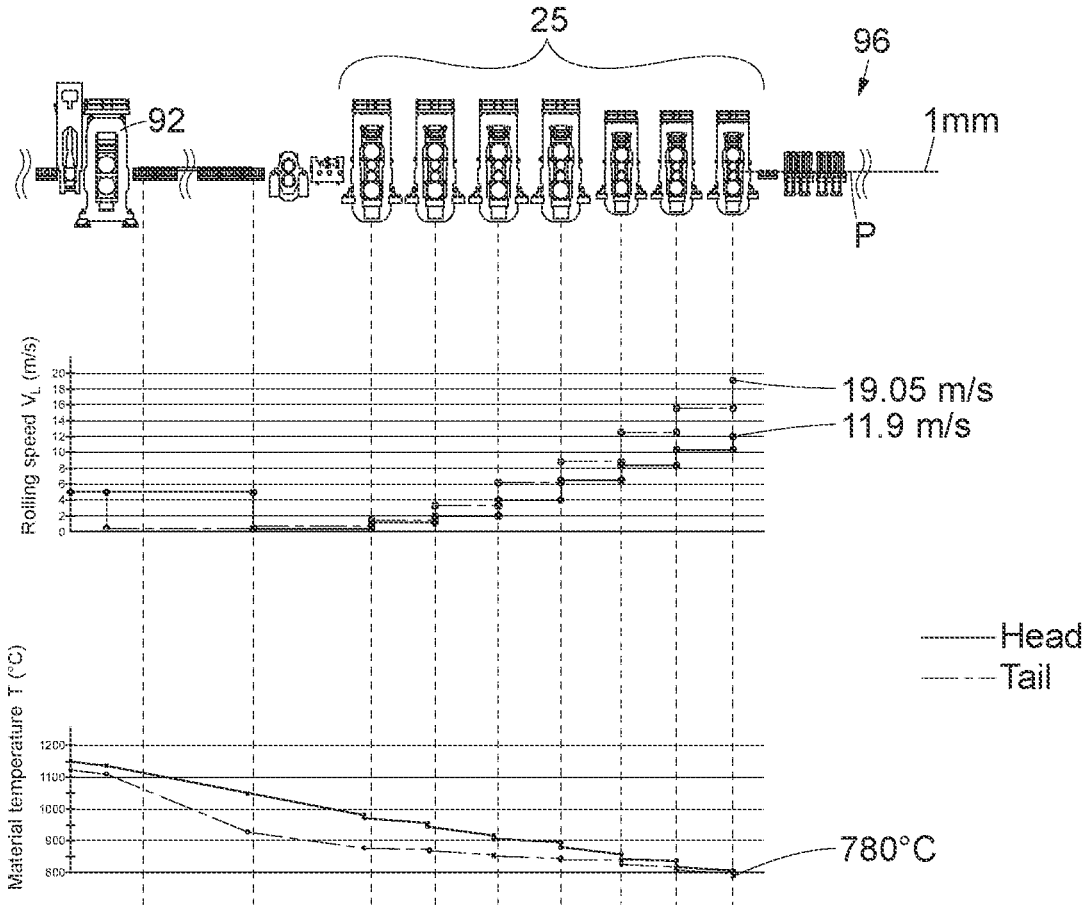
fig. 4 (PRIOR ART)

In the original type of plant 100 shown in FIG. 2, and in the corresponding revamped plant 10 of FIG. 4, downstream of the gas furnace 16, in addition to the descaling device 20, there are provided two reversible roughing stands 23 with corresponding vertical stands 21.

The reversible roughing stands are equipped with descaling means mounted on board and forming an integral part of the stands themselves, which are disposed both on the inlet side and also on the outlet side of each stand (not shown in the drawings).

The corresponding layout described heretofore between the original plant 100 and the corresponding revamped plant 10, whether of the type with one or two roughing stands 23, highlights the advantageous characteristic of the revamping method according to the present invention, whereby most of the plant remains intact as originally installed, to the advantage of costs, timings and the impact of the revamping intervention.

With the revamped plant 10, the intermediate rolled product 51 obtained at exit from the roughing stand/s 23 has a thickness comprised between about 45 mm and about 80 mm, instead of the original 35 mm-45 mm. By way of example only, at the end of the required roughing passes, the intermediate rolled product 51 has a temperature which ranges from about 1020° C. to about 1120° C.

At this point, in order to carry out the revamping of both types of plant 100 shown in FIGS. 1 and 2, the drum shear 27 is removed, and the descaler 24 and two stands of the compact rolling train 25 are disassembled.

The descaler 24 and the two stands are displaced toward the reversible stands 23 at a determinate distance D therefrom, so that the intermediate rolled product 51 is never operatively engaged with both types of stand simultaneously.

In this way, the compact rolling train 25 is divided into two macro rolling units, a pre-finishing unit 26 and a finishing unit 31, which are deliberately distanced from each other by a predetermined distance "d".

The stands of the finishing unit 31 substantially maintain their original installation position, without impacting the revamping intervention.

The revamped rolling train is configured to progressively reduce the thickness of the intermediate rolled product 51 in order to obtain the final strip P with a minimum thickness equal to 0.9-1.2 mm.

In the solution according to the present invention, a pre-finished rolled product 52 exits from the two pre-finishing stands 26 having a thickness comprised between about 10 mm and about 50 mm.

According to the invention, downstream of the pre-finishing unit 26 there is disposed, in this specific case, the same drum shear 27, after possible reconditioning, to trim the heads and tails of the pre-finished rolled product 52, in order to facilitate its entry into the stands of the finishing unit 31 and to reduce the chances of cobble, especially for the production of final strips having a thickness smaller than 3.0 mm.

However, it is not excluded that, according to one variant, the shear 94 can be replaced with an alternative cutting machine, having a different size and functionality from the drum shear 27 originally provided in the plant 100.

The method according to the present invention also comprises positioning a rapid heating device 28 interposed between the pre-finishing unit 26 and the finishing unit 31 of the revamped rolling train.

Preferably, the rapid heating device 28 comprises, for example, an induction furnace disposed downstream of the flying shear 27 and consisting of elements that can be activated selectively, even independently of each other.

The rapid heating device 28 is configured to heat, selectively and in an adjustable manner, the pre-finished rolled product 52 before it enters the finishing stands 31.

The temperature to which the pre-finished rolled product is heated is selected, among other parameters, at least as a function of its thickness and the final thickness of the final strip P, so that the latter has an optimum temperature of at least 830° C. at the outlet of the finishing unit 31, and in particular at the outlet of the last finishing stand.

By way of example only, the temperature to which the pre-finished rolled product 52 is heated, that is, the temperature it has at exit from the rapid heating device 28, reaches a value advantageously comprised between about 1000° C. and about 1100° C., or in any case a temperature such that, also as a function of the operating and product parameters, the temperature of the final strip at exit from the last finishing stand 31 is higher than at least 830° C.

This allows to reduce the value of the rolling mass flow $MF_L$ required to obtain the above mentioned optimum temperature of at least 830° C., for example comprised between 830° C. and 900° C., at the outlet of the last stand of the finishing unit 31.

Figure 7:
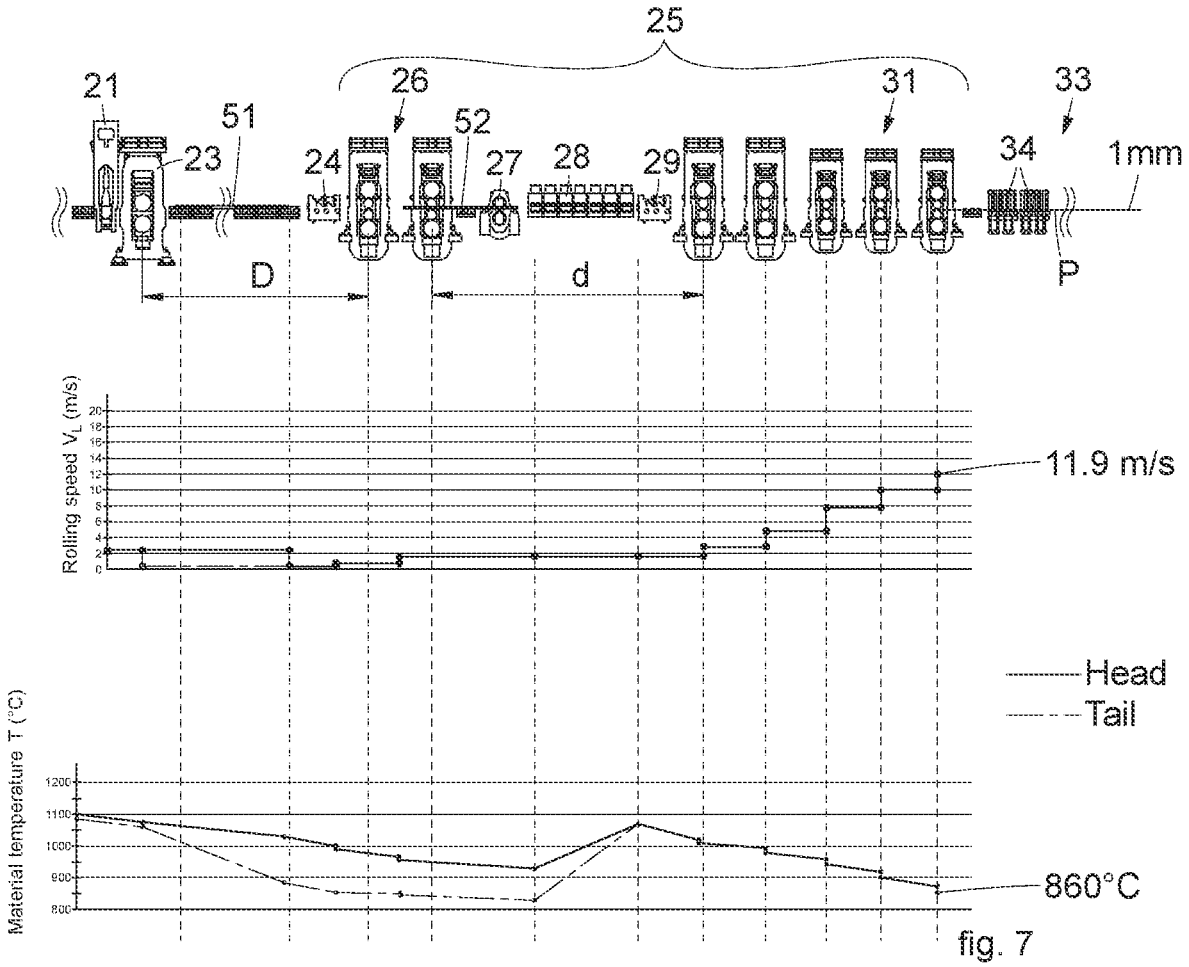
FIGS. 7 and 8 are graphic representations of the relation between rolling speed and outlet temperature of rolled products of different thicknesses, of a revamped HSM plant for producing flat rolled products, in accordance with the present invention.

The reduction of the rolling mass flow $MF_L$ allows both to carry out the rolling with a reduced rolling speed $V_L$, preferably lower than 12 m/s, and at the same time to reach the optimum temperature of at least 830° C. at the outlet of the continuous rolling train 25 even for the tail of the final strip P, eliminating the need for "speed up" as a tool for reaching the target temperature. An example of this embodiment is schematized graphically in FIG. 7.

Advantageously, in the absence of speed-up, the rolling speed $V_L$ in the finishing stands 31 is substantially constant and allows both to keep the temperature of the final strip P between its head and tail constant, and also to choose the most suitable temperature control (for example thermomechanical treatment) as a function of the steel grade and the use of the final strip P.

Another advantage of not performing the speed-up consists in the fact that it allows a high control of both the final shape of the final strip P, for example crown and flatness thereof, which will therefore be advantageously uniform along the entire length of the coil, and also of the mechanical properties of the final strip P which will be advantageously constant and uniform along the entire length of the coil.

This last advantage, which cannot be achieved with plants of the prior art, is of considerable importance, particularly for quality productions such as, for example, final strips P intended for molding.

Figure 8:
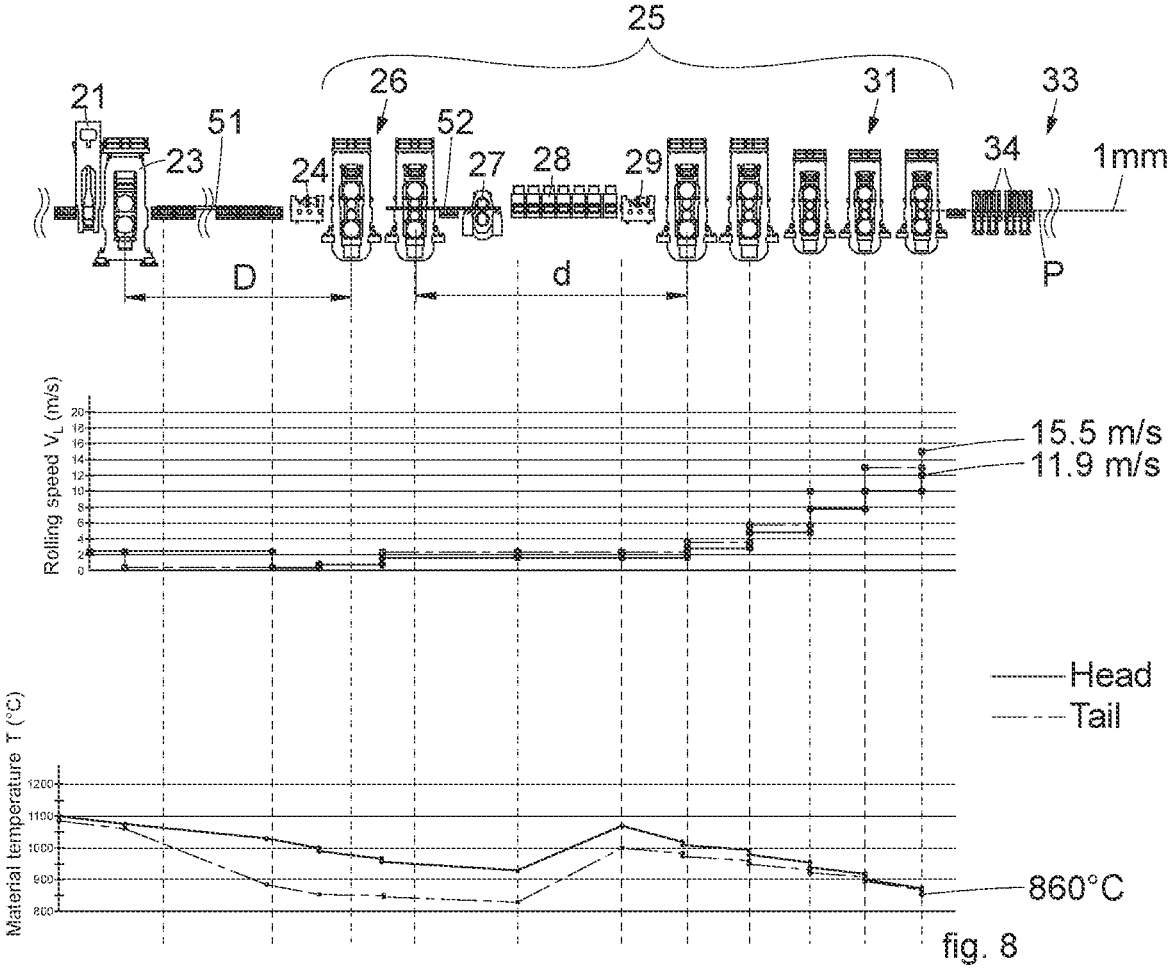

According to some embodiments, it may be necessary to resort to speed-up in order to be able to increase the productivity of the line when very thin thicknesses are produced, or to achieve very high productivity with other thicknesses. An example of this embodiment is schematized graphically in FIG. 8.

In addition to the original plant 100, downstream of the rapid heating device 28 and upstream of the finishing unit 31 there is also disposed a third water descaling device 29, which has the function of further cleaning the surface of the pre-finished rolled product of scale before entering the finishing stands.

Therefore, the scale that has formed on the surface of the pre-finished product is removed, thus avoiding qualitative defects on the rolled strip, such as imprinted scale for example.

Downstream of the finishing unit 31, the cooling device 33 and the showers 34 of the original plant 100 are kept, to cool the strip P.

Furthermore, at the outlet of the showers 34 the two winding reels 36, 38 are kept, to wind the strip P into coils for its subsequent storage and shipment.

It is clear that modifications and/or additions of parts may be made to the method for revamping a plant for producing flat rolled products as described heretofore, without departing from the field and scope of the present invention, as defined by the claims.

It is also clear that, although the present invention has been described with reference to some specific examples, a person of skill in the art shall certainly be able to achieve many other equivalent forms of method for revamping a plant for producing flat rolled products, having the characteristics as set forth in the claims and hence all coming within the field of protection defined thereby.

In the following claims, the sole purpose of the references in brackets is to facilitate their reading and they must not be considered as restrictive factors with regard to the field of protection defined by the same claims.

The invention claimed is:

1. A method for revamping an existing rolling plant, for producing a final strip starting from a slab having a determinate starting thickness, comprising:

at least one heating furnace configured to heat at least said slab to a determinate starting temperature;

at least one reversible roughing stand configured to subject said slab to one or more rolling passes in order to obtain an intermediate rolled product;

a compact rolling train disposed operatively in line with said at least one roughing stand, comprising a plurality of finishing stands located in line with each other and configured to reduce the thickness of said intermediate rolled product until said final strip having a determinate final thickness is obtained;

wherein in order to obtain a revamped plant, the method provides to operate on said existing plant by carrying out at least one step of modifying said rolling train, in which at least one initial stand of said rolling train is moved away from the remaining stands located downstream of it and brought closer to the roughing stand, thus dividing the rolling train into a pre-finishing unit and a finishing unit, wherein said pre-finishing unit is positioned at a minimum distance from said roughing stand such that the intermediate rolled product is not operatively engaged with both respective stands simultaneously, and at least one step of installing a rapid heating device, consisting of selectively activatable elements, between said pre-finishing unit and said finishing unit, in order to heat said pre-finished rolled product, at exit from said pre-finishing unit, so that the temperature of said final strip (P) in correspondence with the outlet of the last stand of said finishing unit is higher than at least 830° C., even for a minimum thickness of less than 1.2 mm.

2. The method as in claim 1, wherein in said modification step said rolling train is divided in such a way that said pre-finishing unit has a number of stands comprised between one and two and said finishing unit has a number of stands comprised between five and six.

3. The method as in claim 2, wherein said pre-finishing unit comprises two stands and said finishing unit comprises five stands.

4. The method as in claim 1, wherein said at least one roughing stand is configured to define said intermediate rolled product having a thickness comprised between about 45 mm and about 80 mm, wherein said pre-finishing unit is configured to define said pre-finished rolled product having a thickness comprised between about 10 mm and about 50 mm, and wherein said finishing unit is configured to define said final strip having a determinate final thickness comprised between about 1 mm and about 26 mm.

5. The method as in claim 1, wherein it provides to position third descaling means between said rapid heating device and said finishing unit.

6. The method as in claim 1, wherein it provides to position a cutting machine in a condition interposed between said pre-finishing unit and said rapid heating device.

7. The method as in claim 1, wherein said determinate starting temperature of said slab is lower than or equal to 1200° C.

* * * * *